United States Patent [19]

Blaser

[11] Patent Number: 5,052,356

[45] Date of Patent: Oct. 1, 1991

[54] METHOD FOR CONTROL OF PRESSURE IN INTERNAL COMBUSTION ENGINES

[75] Inventor: Richard F. Blaser, Edgewater, Md.

[73] Assignee: Sonex Research, Inc., Annapolis, Md.

[21] Appl. No.: 915,970

[22] Filed: Oct. 6, 1986

Related U.S. Application Data

[60] Continuation of Ser. No. 712,460, Mar. 15, 1985, abandoned, which is a continuation of Ser. No. 230,677, Feb. 2, 1981, abandoned, which is a continuation of Ser. No. 14,479, Feb. 23, 1979, abandoned, which is a division of Ser. No. 733,962, Oct. 19, 1976, abandoned.

[51] Int. Cl.[5] ..... F02D 35/02

[52] U.S. Cl. ..... 123/279; 123/279; 123/295

[58] Field of Search ..... 123/193 P, 193 CP, 279, 123/286, 295, 255, 280, 289

[56] References Cited

U.S. PATENT DOCUMENTS

| | | | |
|---|---|---|---|
| 1,165,086 | 12/1915 | Ford . | |
| 1,290,374 | 1/1917 | Shaw . | |
| 1,803,262 | 4/1931 | Lang . | |
| 1,803,263 | 4/1931 | Lang . | |
| 1,816,432 | 7/1931 | Hill . | |
| 1,825,658 | 10/1931 | Dumanois . | |
| 1,901,838 | 3/1933 | Baur . | |
| 1,937,655 | 12/1933 | Lang . | |
| 1,944,352 | 1/1934 | Lang . | |
| 1,981,874 | 11/1934 | Mock | 123/280 |
| 2,076,030 | 4/1937 | Kahllenberger . | |
| 2,076,226 | 4/1937 | Cummins . | |
| 2,098,031 | 11/1937 | Essl . | |

(List continued on next page.)

FOREIGN PATENT DOCUMENTS

| | | |
|---|---|---|
| 648651 | 7/1937 | Fed. Rep. of Germany . |
| 2114901 | 9/1972 | Fed. Rep. of Germany . |
| 863222 | 3/1941 | France . |
| 16-13767 | 9/1941 | Japan . |
| 46-23521 | 7/1971 | Japan . |
| 49-113008 | 10/1974 | Japan . |
| 351633 | 7/1931 | United Kingdom . |

OTHER PUBLICATIONS

Examination of the material presented in "The Controlled Heat Balanced Cycle", Nov. 1974, by A. Pouring, Sonex Research, Inc., Jan. 1985.

Test Evaluation of Blaser Configured Laboratory Engine, by D. Steinmeyer et al., BKM Inc., Aug. 1986.

"The Controlled Heat Balanced Cycle", by Blaser et al., presented at 27th Meeting of American Physical Society, Pasadena, Calif., Nov. 25-27, 1974.

*Primary Examiner*—Joseph L. Dixon

*Attorney, Agent, or Firm*—Bacon & Thomas

[57] ABSTRACT

An improved apparatus and technique for providing increased efficiency and relatively pollutant free operation of internal combustion engines. An internal combustion engine's gas cycle is refined by forming a secondary balancing non-combusting chamber within the main combustion chamber of each cylinder. The balancing chamber is constructed on a piston surface or within the piston body and operates as a pressure exchange or wave generator during the gas cycle of the internal combustion engine. This permits control of the pressure and temperature within the combustion chamber during the liberation of heat caused by combustion of fuel and air on the power cycle of the engine. The apparatus, the balancing chamber, controls pressure and temperature during this cycle by introducing expansion and compression waves, in the combustion zone during burning of the fuel, that follow one another in sequence without interruption throughout the entire power cycle of each cylinder of the internal combustion engine. The oscillating pressure exchange between the expansion and the compression waves within the combustion chamber during burning of the fuel in each cylinder supplies clean air to support more complete combustion and provides lower combustion temperatures and pressures during operating of the internal combustion engine, thus decreasing the formation of engine exhaust pollutants.

1 Claim, 6 Drawing Sheets

U.S. PATENT DOCUMENTS 2,173,081 9/1939 Barkeij .
2,446,280 8/1948 Hancock .
2,573,536 10/1931 Bodine, Jr. .
2,662,514 12/1953 Bodine, Jr. .
2,662,516 12/1953 Bodine, Jr. .
2,662,517 12/1953 Bodine, Jr. .
2,758,576 8/1956 Schlamann .
2,910,826 11/1959 Mansfield .
2,917,031 12/1959 Nestorovic .
2,991,766 7/1961 Candelise .
2,991,767 6/1965 Candelise .
3,132,633 5/1964 Zimmerman ..... 123/193 P
3,186,390 6/1965 Galic .
3,408,992 11/1968 von Seggern et al. .
3,561,412 2/1971 Yagi et al. .
3,730,163 5/1973 Elsbett et al. .
3,810,454 5/1974 Hunt .
3,897,769 8/1975 Jozlin ..... 123/279
3,898,965 8/1975 Fischer .
3,919,982 11/1975 Goto et al. .
3,923,032 12/1975 Studenroth ..... 123/193 P
3,991,729 11/1976 Notaro .
4,023,541 5/1977 Sakamoto .
4,060,059 11/1977 Blaser .
4,067,301 1/1978 Jarry .
4,079,703 3/1978 Yamane et al. ..... 123/295
4,104,989 8/1978 Resler, Jr. .
4,105,008 8/1978 Resker, Jr. ..... 123/193 P
4,128,092 12/1978 Yokota et al. ..... 123/193 P

METHOD FOR CONTROL OF PRESSURE IN INTERNAL COMBUSTION ENGINES

This application is a continuation of application Ser. No. 712,460, now abandoned filed Mar. 15, 1985, which is a continuation of application Ser. No. 230,677, filed Feb. 2, 1981 (now abandoned), which is a continuation of application Ser. No. 014,479, filed Feb. 23, 1979 (now abandoned) which is a division of Ser. No. 733,962 filed Oct. 19, 1976 (now abandoned).

BACKGROUND OF THE INVENTION

The present invention relates to an apparatus and technique for increasing the efficiency of operation of an internal combustion engine and more particularly to an improved apparatus and technique that permits control of generated pressures and temperatures during combustion of fuel in the combustion chamber of an internal combustion engine for allowing predetermined parameters of pressure and temperature within the combustion zone, in order to, decrease the amount of pollutants exhausted by the engine during operation.

Efficient conversion of energy into useful work has been the goal of engine designers since the creation of internal combustion engines utilizing the Otto cycle, i.e. reciprocating rotary, diesel engines and the like. In view of the scarcity and high cost of engine fuels, engineers and engine designers have been grappling with the fundamental problems of exhaust emission pollutants and increased fuel economy, yet striving to improve performance in these areas without sacrificing engine performance and efficiency. This has produced internal combustion engines that are operating in a critical compromise of fuel/air mixture composition, pressure and temperature that results in the engine generating and discharging harmful pollutants (CO, NOX and HC) in order to achieve adequate performance.

To deal with the NOX emissions designers have retarded spark and employed such devices as exhaust gas recirculation systems, each which decreases overall engine performance, with a resultant decrease in engine performance and which further cause increases in HC and CO emissions. These increased HC and CO emissions must be cleared up by expensive catalytic converters which in turn require unleaded fuels.

Continued distortion of the combustion process in internal combustion engines can only result in a hodge potch of engine control devices that increase engine manufacturing cost and result in low engine performance with low fuel economy.

Realization in both industry and the government that internal combustion engines will require drastic design changes to achieve permissible government pollution standards has resulted in considerable developmental efforts to investigate the combustion process. These efforts have resulted in various techniques such as changing the size and shape of the combustion chamber, relocation of the spark within the combustion chamber, the use of multiple-source ignition schemes and the use of stratified charge designed combustion chambers.

Various modifications of a combustion chamber shape into a hemispherical chambers with changes in conventional spark locations by designing spark plugs with extended gap designs has reduced HC emissions but this design has mechanical manufacturing difficulties that far out weigh the amount of reduced emissions obtained.

Another technique presently being utilized is the use of a multiple-source ignition configuration to cause creation of a torch-like flame to shoot into a homogeneous-lean air/fuel mixture within the combustion chamber with the torch fueled by the same fuel as the main chamber. The torch ignition mixture is mechanically separated from the main chamber by an antechamber constructed in the engine head to open into the main combustion chamber.

Another popular scheme is the stratified charge engine (SC) configuration which can have numerous variations. The basic idea of the SC engine involves introduction of a rich, easily ignitable mixture in the vicinity of the spark plug and a very lean mixture throughout the rest of the chamber, so as to have a differing air/fuel ratio in various areas within the cylinder chamber, rich in some lean in others, with the resulting overall air/fuel ratio considerably leaner than stoichiometric. The burning takes place in stages with a small volume of rich air/fuel mixture being ignited first to create a flame that spreads out into the combustion chamber charged with very lean air/fuel mixture causing ignition of these areas more thoroughly and burning them more completely than in conventional internal combustion engines.

The above are a few of the more pertinent devices of the numerous proposals that have been set forth to reduce pollution and increase engine and fuel performance. Each has some distinct disadvantage because of its interaction with other engine parameters inherent in the Otto cycle or diesel cycle engine. In view of this there has been created a need in the industry of an internal combustion engine operating on a gas cycle that has the characteristics of the Otto cycle but which has a process of combustion that is time controlled and will operate with the advantage of high compression ratio and fuel rich air ratios with the efficiency and total fuel oxidation of the diesel without its disadvantages of high pressure, high temperature and knock tendency.

Accordingly, the present invention has been developed to overcome the specific shortcomings of the above known and similar techniques and to provide an improved apparatus and technique for generating a heat balanced cycle for internal combustion engines with performance, pollution characteristics, and a multifuel burning capability that is not present nor possible with conventional Otto or diesel cycle engines.

SUMMARY OF THE INVENTION

An object of the invention is to reduce the amount of pollution of the atmosphere by exhaust gases from an internal combustion engine.

Another object of the invention is to increase the efficiency of conventional internal combustion engines without substantial modifications.

An object of the invention is to decrease the fuel consumption of an internal combustion engine.

An object of the invention is to provide an internal combustion engine with a controlled heat balanced cycle for achieving a relatively pollution free process of combustion.

A further object is to provide a modified internal combustion engine that is capable of manufacture by existing technology and production machinery.

An object of the present invention is to provide an internal combustion engine that can use a variety of fuels and that generates little or no pollutions in its exhaust gases.

An object of the present invention is to provide an internal combustion engine with a combustion process that reduces peak cycle pressures and temperatures to a lower value than those present in conventional internal combustion engines.

An object is to provide an internal combustion engine that has multifuel operational capabilities.

An object of the present invention is to provide an apparatus that will convert Otto and Diesel cycle reciprocating and rotary engines to operate on a controlled heat balance cycle.

Accordingly, the general purpose of the invention is to provide a technique and apparatus to refine the Otto cycle of present internal combustion engines to operate on a heat balanced cycle that has a time controlled natural process of combustion for improving engine performance and eliminating exhaust pollutants. A balancing chamber is formed in the combustion chamber of the internal combustion engine; this chamber allows balanced cycle operation on the compression and power stroke of the piston. On the admission or intake stroke a charge of air and fuel are directly admitted via a valving arrangement into the combustion chamber. The decrease in pressure caused by atmospheric pressure and the receding piston draws an inflow of air and fuel into the combustion chamber with a non-homogeneous charge of fuel and air, that is fuel rich from top to bottom. As compression starts the relatively lean mixture is forced into the balancing chamber via a passageway, increasing the pressure within the balancing chamber or reservoir as the pressure increases in the combustion chamber by the piston moving toward TDC. At ignition and burning of the fuel-rich mixture there is an increase in the pressure at quasi-constant volume to drive a pressure shock wave through the passageway into the balancing chamber or reservoir. Simultaneously, the expansion wave which drives the shock wave propagates into the combustion chamber decreasing the pressure in the combustion chamber. A pressure in-balance occurs by the shock compression of the slightly diluted air charge in the reservoir causing the air in the reservoir to flow out into the combustion chamber for replenishing the air within the combustion chamber for sustaining complete combustion of the fuel. These expansion-compression waves interact throughout combustion during the power stroke and act in an oscillatory manner to draw air from the balancing chamber into the combustion chamber a substantial number of times. An additional effect of the alternating expansion-compression waves causes stirring at the combustion zone at supersonic through sonic speeds. Passage of weak shock waves into the combustion chamber will fractionate the fuel particles, effectively atomizing them for rapid combustion and thus eliminates the need of atomization of fuel by carburetors or like devices as fuel is drawn in the combustion chamber.

The reservoir in the combustion chamber is formed by providing a pressure exchange cap spaced a predetermined distance from the piston surface. The diameter dimension of the cap is less than the diameter dimension of the cylinder to form a spaced gap or passageway between the peripheral edge of the cap and the cylinder wall surface. The cap is heated by the burning gases during the combustion cycle and acts as a heat exchanger to provide heating of gases in the combustion chamber during the compression cycle. Fuel is fed into the combustion chamber by means of a carburetor like or a injection like system of fuel supply via an intake manifold and intake valve arrangement. An air inlet is provided to permit atmospheric air pressure to flow directly into the combustion chamber whenever the intake valve opens preceeding delivery of the fuel to the combustion chamber to cause substantially fuel free air to be drawn into the balancing chamber or reservoir.

BRIEF DESCRIPTION OF THE DRAWINGS

For a complete understanding of the nature and features of the invention, reference should be made to the following detailed description taken in connection with the accompanying drawings wherein.

DETAILED DESCRIPTION OF THE INVENTION

A comparison of the three ideal gas cycles, Otto cycle, Diesel cycle and heat balanced cycle, follows to provide a better understanding of the heat balanced cycle technique utilized in operation of an internal combustion engine, equipped with a pressure exchange cap.

Figure 1:
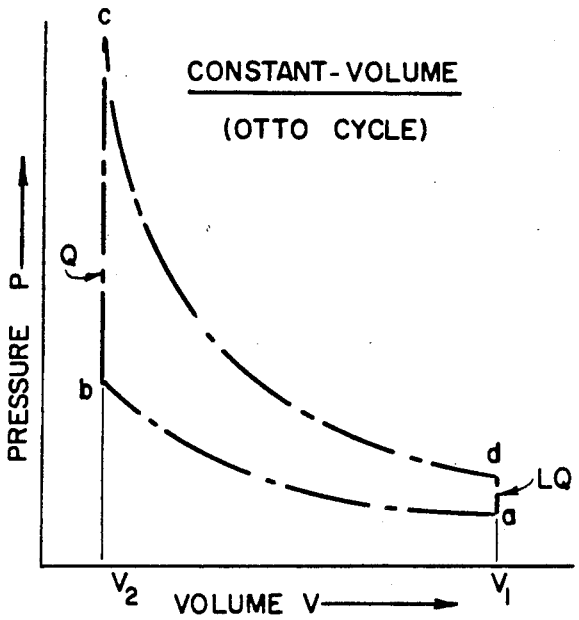
FIG. 1 shows a pressure-volume diagram of the Otto cycle.

Referring now to the graph of FIG. 1, that illustrates a simplified pressure volume diagram of an internal combustion cycle known in the art as the constant volume or Otto cycle. Starting at point a, air at atmospheric pressure is compressed adiabatically in a cylinder to point b, heated at constant volume to point c, allowed to expand adiabatically to point d, and cooled at constant volume to a point a, after which the cycle is repeated. Line ab corresponds to the compression stroke, bc to the explosion, cd to the working stroke, and da to the exhaust of an internal combustion engine. $V_1$ and $V_2$, are respectively the maximum and minimum volumes of air in the cylinder. The ratio of $V_1/V_2$ is compression ratio of the internal combustion engine.

The heat input Q to the cycle is the quantity of heat supplied at constant volume along the line bc. The, LQ exhaust heat, representing the quantity of loss of heat, is removed along da. The following simplified equations represents the efficiency of the Otto cycle:

$$Q = \text{heat added at constant volume} \quad (1)$$

$$LQ = \text{rejected heat}$$

$$\eta_{Otto} = \frac{AQ - LQ}{AQ} \quad (2)$$

$$\eta_{Otto} = \text{efficiency}$$

Figure 2:
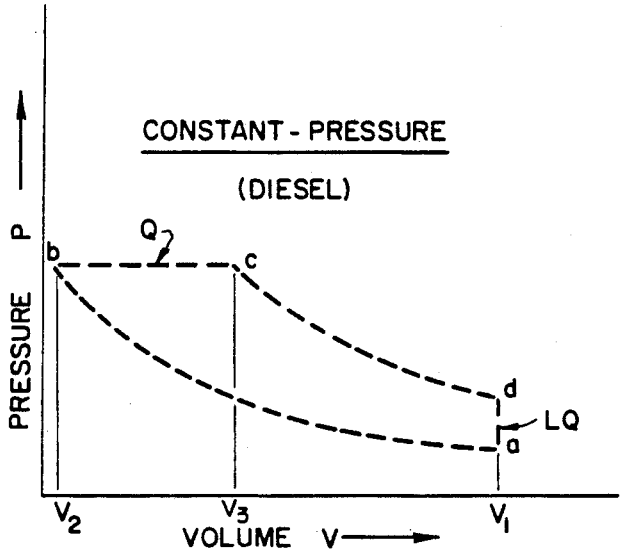
FIG. 2 shows a pressure-volume diagram of the Diesel cycle.

Reference should now be made to FIG. 2 which illustrates a Diesel cycle of an internal combustion engine for an understanding of its operation with respect to the operation of the Otto cycle explained above. The idealized air-Diesel cycle starting at point a, air is compressed adiabatically to point b, heated at constant pressure to point c, expanded adiabatically to point d, and cooled at constant volume to point a. Since there is no fuel in the cylinder of a Diesel engine on the compression stroke, preignition cannot occur and the compression ratios may be much higher than that of an internal combustion engine operating on the Otto cycle. Therefore, somewhat higher efficiencies can be obtained than those obtained for the Otto cycle. The following simplified equations define the various parameters of the Diesel engine cycle:

$$Q = \text{heat added at a constant pressure} \tag{3}$$

$$LQ = \text{heat rejected}$$

$$\eta_{Diesel} = \frac{BQ - LQ}{BQ} \tag{4}$$

$$\eta_{Diesel} = \text{efficiency}$$

Figure 3:
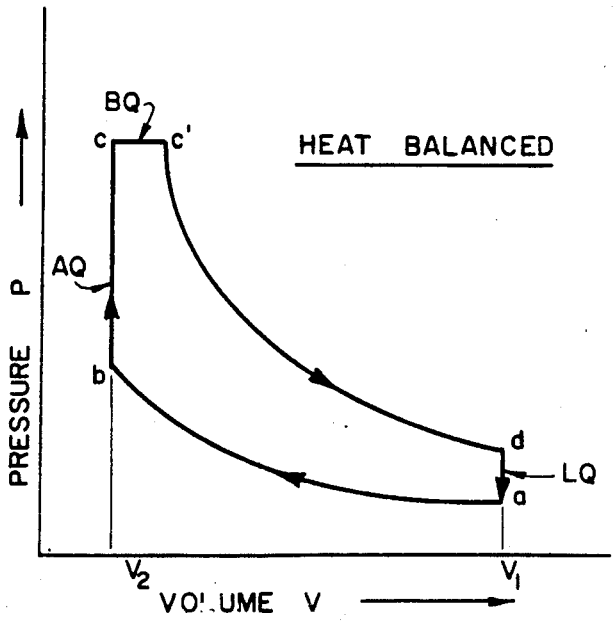
FIG. 3 shows a pressure-volume diagram of the heat balanced cycle.

The heat balanced cycle is illustrated by the pressure-volume diagram of FIG. 3 drawn from the same heat input Q. Line ab corresponds to the adiabatic compression bcc' shows the addition of heat with bc corresponding to the part of the heat added at constant volume and cc' to the remaining heat at constant pressure, c'd is the adiabatic expansion and da the exhaust. Reference to the diagram shows, the quantity of heat Q, added is now divided into two heat quantities, AQ at a constant volume and BQ at a constant pressure, thus maintaining the same quantity of heat Q except that this parameter is divided into two events. The following simplified equations set forth the relationship of the operating parameters of the heat balanced cycle:

$$AQ+BQ=Q \tag{5}$$

AQ is heat added at a constant volume
BQ is heat added at a constant pressure
Therefore:

$$A+B=1 \tag{6}$$

The balancing ratio is defined as $$\beta = \frac{B}{A} \tag{7}$$

therefore, $$A = \frac{1}{1+\beta} \text{ and } = \frac{\beta}{1+\beta} \tag{8}$$

The Otto cycle is the limit when A is 1 and the Diesel cycle is the limit when A=0. The variation of $\beta$ will combine the Otto and Diesel cycles. The efficiency of the heat balanced cycle is expressed as:

$$\eta_\beta = \frac{Q - LQ}{Q} = \frac{AQ + BQ - L[AQ] - L[BQ]}{Q} \tag{9}$$

$$\eta_\beta = \frac{AQ - L[AQ]}{Q} + \frac{BQ - L[BQ]}{Q}$$

-continued $$\eta_\beta = A\frac{AQ - L[AQ]}{AQ} - \frac{BQ - L[BQ]}{BQ}$$

$$\eta_\beta = \frac{AQ - L[QA]}{Q} + \frac{BQ - L[QB]}{Q}$$

$$\eta_\beta = A\frac{AQ - L[QA]}{AQ} + B\frac{BQ - L[QB]}{BQ} \tag{10}$$

Referring to the efficiency of the cycles, $$\eta_\beta = A\eta_V + B\eta_P;$$

$$\eta_V = 1 - \left(\frac{1}{r}\right)^{k-1}; \eta_P = 1 - \left(\frac{1}{r_B}\right)^{k-1} \frac{a_B k - 1}{k(a_B - 1)}$$

$$\text{Calling } \gamma = \left(\frac{P_3}{P_4}\right)^{\frac{1}{k}} \text{ and } r_B = \gamma \cdot r.$$

The efficiency of the Controlled heat balanced cycle is:

$$\eta_\beta = 1 - \left(\frac{1}{r}\right)^{k-1} \frac{1}{1+\beta}\left[1 + \beta\left(\frac{1}{\gamma}\right)^{k-1} \frac{a_B{}^k - 1}{k(a_B - 1)}\right];$$

The efficiency limits of the heat balanced cycle are those of the Otto and Diesel cycles with the same design compression ratio, or:

$$\eta_\beta \to 1 - \left(\frac{1}{r}\right)^{k-1} \text{ when } \beta \to 0 \text{ or } A \to 1, B \to 0 \text{, Otto cycle}$$

$$\eta_\beta \to 1 - \left(\frac{1}{r}\right)^{k-1} \frac{a^k - 1}{k(a-1)} \beta \text{ when } \to \infty \text{ or } A \to 0, B \to 1 \text{ Diesel cycle}$$

Figure 4:
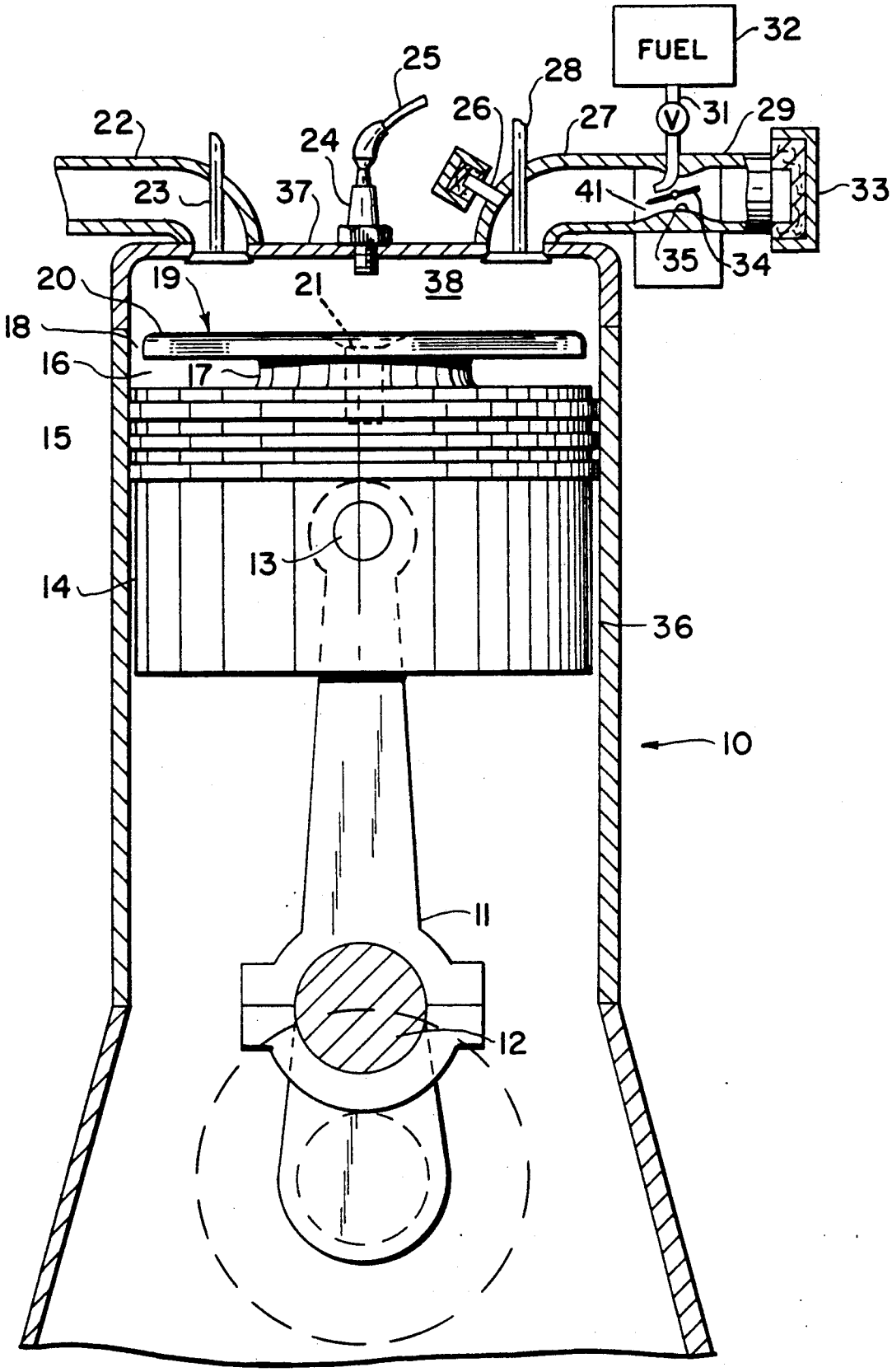
FIG. 4 is a diagrammatic representation of the inventive apparatus installed in an internal combustion engine.

Referring now to the drawing of FIG. 4, that shows a diagrammatic representation of an embodiment of a balancing chamber or reservoir formed on a piston for refining the Otto cycle of an internal combustion engine to function on a heat balanced four stroke cycle. An engine housing or block 10 forms a chamber for a reciprocating piston 14 that is attached by means of wrist pin 13 to connecting rod 11. A crankshaft 12 is coupled to connecting rod 11 by means of a journal bearing to permit reciprocating motion of piston 14 to be transformed into rotating mechanical energy that may be utilized to drive machinery, an automobile or like device, for providing work output.

The inner wall of engine housing 10, adjacent the wall of piston 14, forms a cylinder wall 36 that is in contact with rings 15 to provide a gas pressure tight seal between moving piston 14 and cylinder wall 36 to prevent the escape of high pressure gases generated by burning fuel in combustion chamber 38. Attached to engine housing 10 is cylinder head 37 forming a closed combustion chamber between the upper most portion of housing 10 and the inner recessed portions of the head. Cylinder head 37 has two ports, exhaust and intake, that open and close by means of operation of exhaust valve 23 and intake valve 28 arrangements, respectively. These valves are opened and closed in time sequence with the reciprocating movement of piston 14 by means of valve lifters, push rods, camshafts, and the like, not shown, to allow the internal combustion engine to operate on a four stroke Otto cycle.

Attached to cylinder head 37 is an intake manifold 27 that forms a closed passageway for allowing the flow of fuel and atmospheric air to combustion chamber 38. An air filter 33 is provided to filter air entering a carburetor like device 29 through venturi 35, that has nozzle or port 41 attached to fuel container 32 via a valve and fuel line 31. Air flowing through venturi 35 creates a vacuum to draw fuel from fuel container 32 into combustion chamber 38. Carburetor like device 29 may be replaced by other fuel delivery devices such as fuel ejectors or like devices, known to those skilled in the art. A throttle plate 34 attached to a linkage arrangement, not shown, controls the amount of vacuum through venturi 35 by restricting air flow through the venturi for controlling the amount of fuel delivered to the engine. An additional linkage arrangement, not shown, may be coupled to control air flow through air inlet 26 to further control the amount of atmospheric air delivered to the engine during its operation. Air inlet 26, open to atmospheric air, permits a large volume of air to be delivered to combustion chamber 38 on the intake stroke of the engine prior to delivery of any fuel laden air charge. This air vent is positioned adjacent intake valve 28, as shown, but may be located at any position between carburetor device 29, a fuel ejector or other fuel delivering device, and the intake valve port of intake valve 28.

A spark plug 24 is attached in cylinder head 37 in a conventional manner, and operates to deliver an electric voltage to create a spark in combustion chamber 38 in proper timing sequence with other engine elements to ignite fuel within combustion chamber 38, for creating power to drive piston 14.

A cap like element 20 is attached to piston 14 at its surface face by means of a rivet, bolt or like fastening device. This cap like portion 19 is of mushroom—like shape with a thickened cylinderical stalk-like center portion that has one of its circular face surfaces in contact with the circular surface of piston 14. Integral with the other circular surface of stem-like portion 17 is a relatively thin cylinderical top 20 that is spaced a predetermined distance 18 from cylinder wall 36. The remaining exposed surface of piston 14, the dimensional height of the stem-like portion 17, and inner surface of top 20, form a chamber 16 open to the combustion chamber by a space or passageway 18, defined by the inner cylinder wall surface and the edge of cap 19 which may extend the entire outer perpherical distance of top 19 or some predetermined portion, thereof. Chamber 16 is sealed on its lower side by means of piston rings 15. The reservoir 16 is thus, formed by a portion of the top surface of piston 14 an inner surface portion of cap 19 and the cylinderical wall of stem element 17.

Figure 4A:
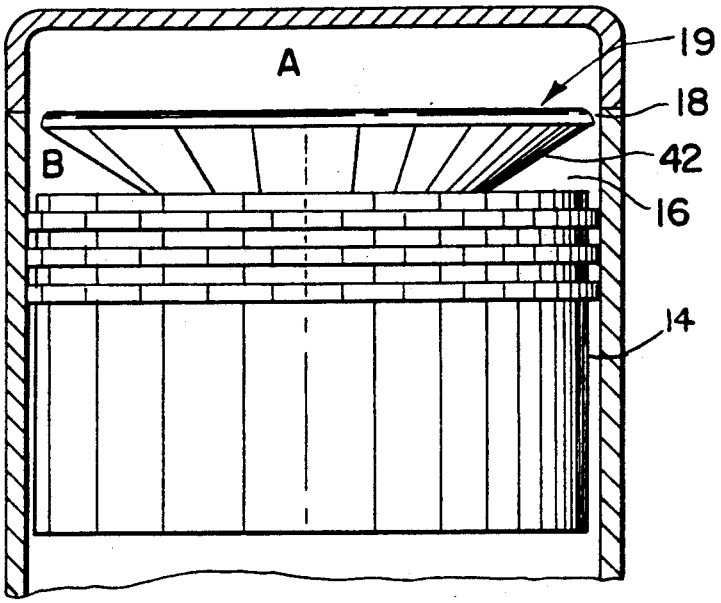
FIGS. 4*a* and 4*b* are diagrammatic representations of pressure exchange cap shape.
Figure 4B:
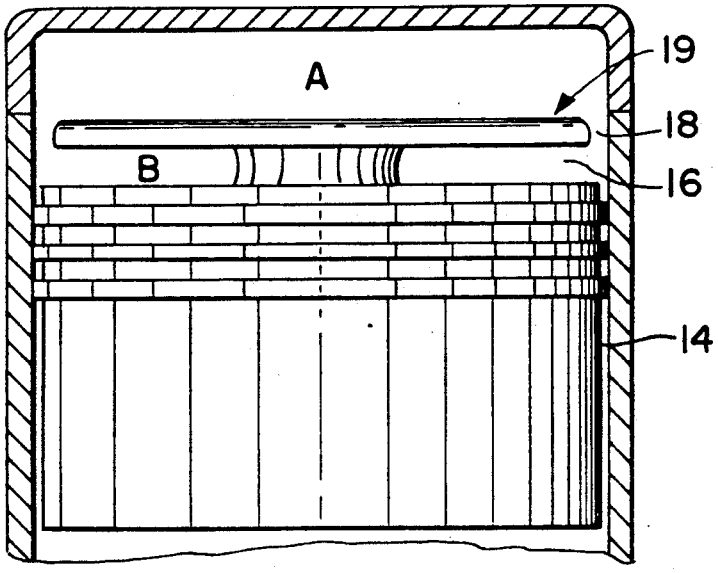

Although cap like element 19 is described as fastened to the piston it is to be understood that cap 19 may be integral with piston 19 and the chamber may be machined or shaped in the piston in the same manner as piston ring grooves. Additionally, it is to be understood that although chamber 16 is shown as formed with parallel sides, the sides may be tapered to form of a truncated cone shaped cap 42 as shown in FIG. 4A or constructed with diametrically opposing sides to form a balancing chamber or reservoir 16 without departing from the spirit of the invention.

The operation of an internal combustion engine on the heat balanced cycle may be best understood by reference to FIG. 3 which shows a p-v diagram of the heat balanced cycle and FIG. 5 (A through G) that illustrates the operating sequence of the heat balanced engine cycle during its four stroke operation. FIG. 5A illustrates piston 14 completing an exhaust stroke with the exhaust valve 23 about to close, with piston 14 moving upward forcing the flow of the burned gases, depicted by arrows, out through the exhaust valve port through a passageway in exhaust manifold 22. At this point intake valve 28 is closed and no air or fuel is flowing through intake manifold passageway 27. Air vent 26 located adjacent the inlet valve port has allowed a charge of fuel free air at atmospheric pressure to fill the entire volume of the intake passageway in the intake manifold up to and through venturi 35. As intake valve 28 opens, best shown with reference to FIG. 5B, piston 14 positioned near top dead center (TDC) moves downwardly enlarging the space at the top of the cylinder, atmospheric air pressure and a decrease in air pressure due to the receding piston draws an inflow of air filling the space in the cylinder. The inflow of air first entering the combustion chamber 38 is the charge of air within the intake manifold passageway that is replenished somewhat by air vent 26 before sufficient vacuum is generated in venturi 35 to draw a charge of rich fuel laden air into the cylinder chamber. As the piston reaches its lowest position, bottom dead center (BDC), the cylinder space has been filled with a varying rich fuel-air charge from cylinder head 37 to piston 14. This charge is very rich in fuel in the vicinity of the cylinder head and leans out to substantially no fuel in the vicinity of the surface of cap 19 and within reservoir 16.

Figure 5A:
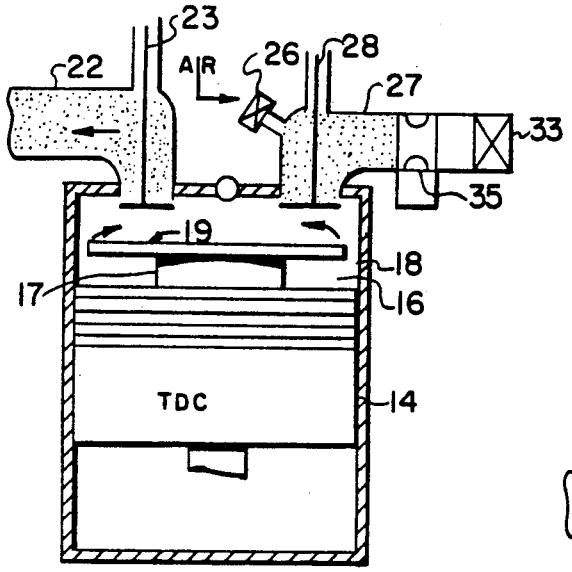
FIG. 5 (A–G) are illustrations of the sequence of operation of a heat balanced engine cycle.
Figure 5B:
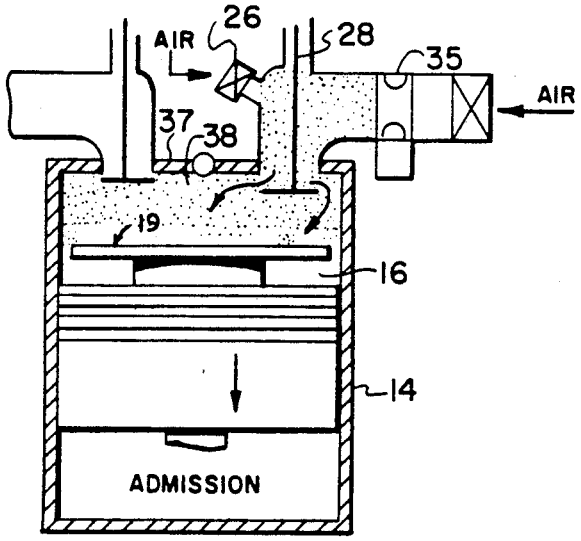
Figure 5C:
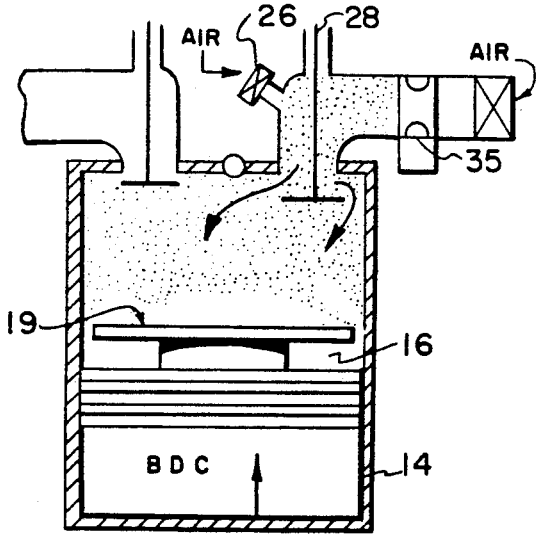

As piston 14 reaches its lower most point of travel within the cylinder, (BDC), the pressure inside the cylinder is still less than atmospheric pressure and additional air and fuel can enter the cylinder; even after the cylinder begins to move upward. Therefore, the intake valve 26 does not close until the crankshaft arm 11 is a predetermined amount of travel past BDC, this is best shown by the illustration of FIG. 5C.

Figure 5D:
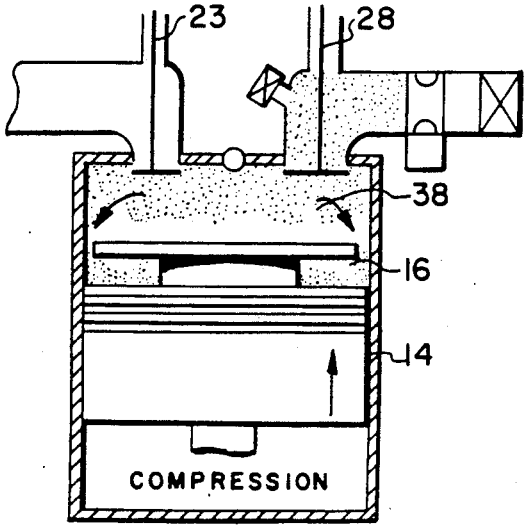

After the intake stroke, best shown by reference to FIG. 5D, both valves (23, 28) are closed and piston 14 moves upward on the compression stroke. Piston 14 compresses the air and fuel charge by pushing it upward into a small decreasing space between the top of the cylinder and the cylinder head that forms combustion chamber 38. Throughout the upward movement of pistion 14 an amount of very lean air/fuel charge is forced into reservoir 16. During operation of the engine the burning gases heat top 20 which acts as a heat exchanger and causes heating of the fuel charge during compression as the charge flows over and around it, thus providing additional heating of the gases.

Figure 5E:
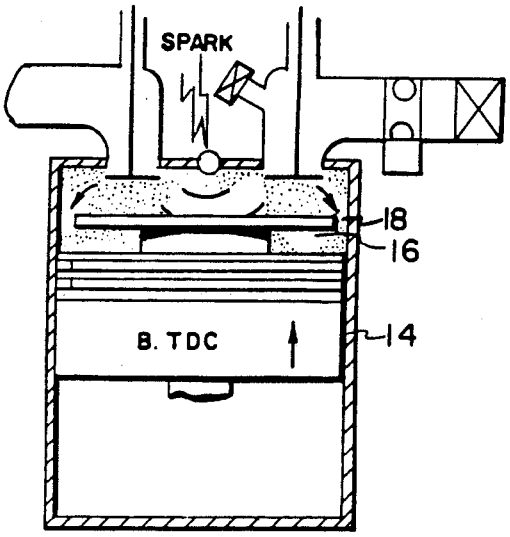
Figure 5F:
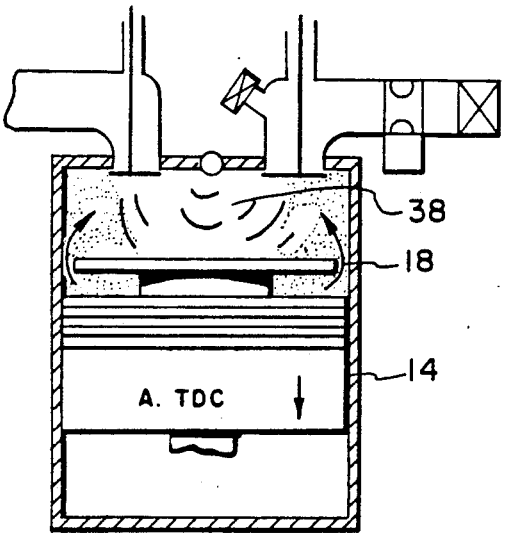

FIG. 5E, illustrates the first phase of the combustion with piston 14 near TDC and both valves closed. Piston 14 has compressed the air/fuel charge to give greater force to the expanding gases when combustion takes place. At this point, a spark ignites the fuel charge and it burns with an explosive force driving piston 14 downward. The pressure increase at quasi-constant volume, combustion shown as line vc in FIG. 3, drives a compression shock wave into reservoir 16, via passageway 18, compressing the air charge against the internal walls of reservoir 16. Simultaneously, the expansion wave created by combustion of the gases which drives the shock wave propagates into the space between the top of cap 14 and cylinder head 37 decreasing the pressure in combustion chamber 38. A pressure in-balance occurs due to the shock compression of the very lean substantially fuel free mixture in reservoir 16 causing the lean air charge within chamber 16 to flow out via passageway 18 into combustion chamber 38. This condition is illustrated best with reference to FIG. 5F and FIG. 3 which line cc' shows the part of the combustion at quasi-constant pressure. The connecting rod 11 transmits the force created in the power store to crankshaft 12 which turns the crankshaft to produce a power output.

Figure 5G:
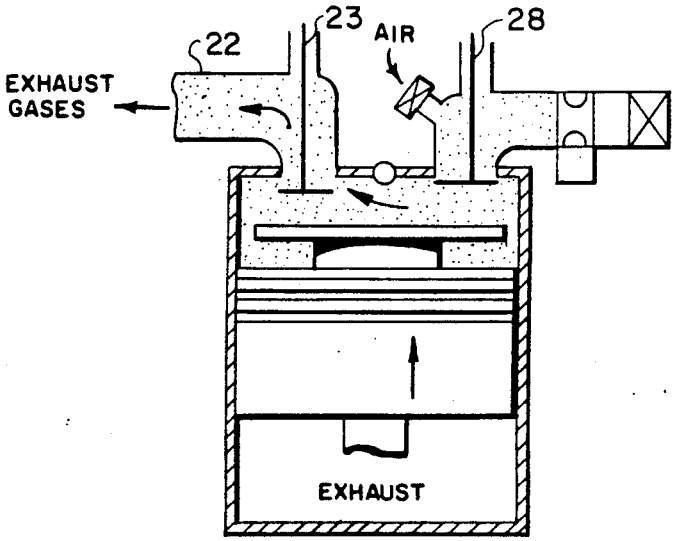

The exhaust stroke begins when the piston reaches BDC at the end of the power stroke, best shown with reference to FIG. 5G. Exhaust valve 23 opens, piston 14 moves upward in the cylinder and forces the burning gases out through the exhaust passageway 22 via exhaust port into exhaust manifold 22. At the end of the exhaust stroke, exhaust valve 23 closes and the intake stroke starts to repeat the engine cycle.

The interaction of the reservoir and the combustion chamber is crucially important for proper heat balance engine cycle operation. To provide the necessary oscillating action of the compression expansion waves during the time period of the power stroke as they successively interact within the combustion zone and to provide a pumping action to draw fuel free air from chamber 16 throughout the power stroke requires certain dimensional interrelationship of combustion chamber volume A, chamber volume B and passageway 18. In an internal combustion engine the balancing ratio $\beta = B/A$ equation 7 is normally in a range of from 0.20 to 3. The passageway opening 18 should be in the range of 0.05 to 0.200 inches. The lower value typical for standard size cylinder of automobile, engines, the higher value typical for compression ignition engines.

Table 1 sets forth the pressures and temperatures present at designated points on the pressure-volume curves of FIGS. 1 and 3 in comparison of two identical engines; one operating on a heat balanced cycle and the other on an Otto cycle.

| Otto Cycle = 8 $\beta = 0$ | | | Heat Balanced Cycle = 8 $\beta - .43$ | | |
|---|---|---|---|---|---|
| State | Psia | T° R | Psia | T° R | State |
| a | 14.7 | 600 | 14.7 | 600 | a |
| a | 240 | 1200 | 240 | 1200 | b |
| c | 1000 | 4980 | 670 | 2800 | c |
| c | 1000 | 4980 | 670 | 3070 | c' |

A two-stroke engine cycle that has a similar combustion cycle as the four stroke but that requires only one revolution of the crank shaft can also be modified to operate on a heat balanced cycle.

The compression stroke of the working piston draws a fresh charge of air into the crank case. On the compression stroke this charge is compressed and fuel is injected into the combustion chamber. A cap structurally similar to the one described above operates in the same manner to sustain combusion during the burning of fuel-air charge in the combustion chamber to cause the engine cycle to bé refined to a heat balanced cycle.

The apparatus used to modify reciprocating internal combustion engines, that is, to produce power by pistons moving up and down in cylinders for driving a crankshaft which changes the up-and-down motion to rotary motion, may also be used to improve performance of rotary engines. That is, engines which power is produced by the action of a rotor turning inside an oval shaped combustion chamber, i.e. the WANKLE engine.

Figure 6:
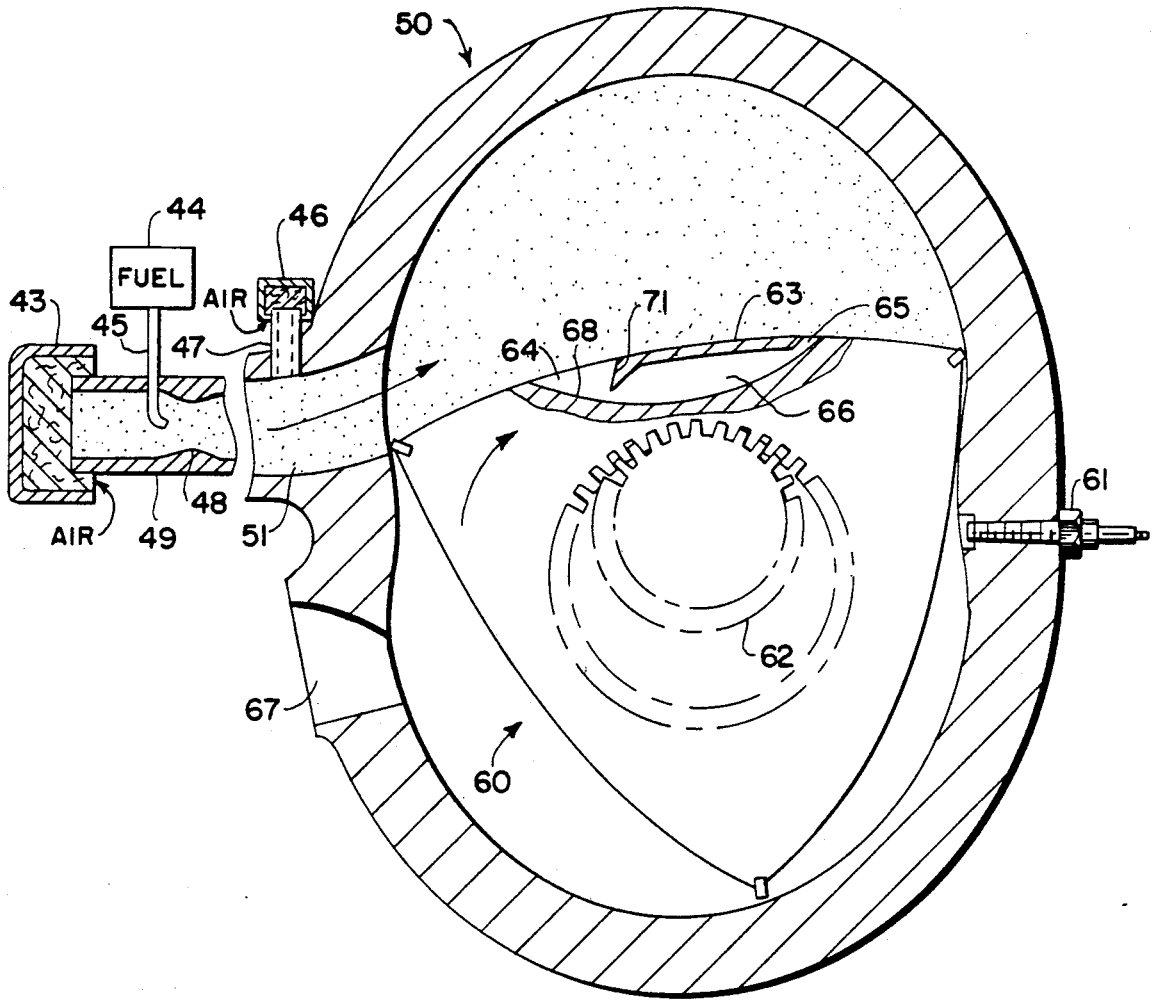
FIG. 6 is a diagrammatic representation of the inventive apparatus installed in a rotating internal combustion engine.

The conventional piston is replaced with a three-sided rotor 60, best shown with reference to FIG. 6. Rotor combustion pockets are rotated past an intake port 51, a spark plug 61 and an exhaust port 67 to cause rotating combustion. The combustion cycle follows the familiar pattern of the conventional four-stroke-cycle, Otto cycle, of an internal combustion engine in the sequence of events-intake, compression, power and exhaust, as shown in the pressure-volume graph illustrated in FIG. 1. Modification of the engine with reservoirs will refine its cycle so that it operates on a heat balanced cycle, illustrated in FIG. 3, in a similar manner as the explanation above with respect to the reciprocating engine.

Figure 7:
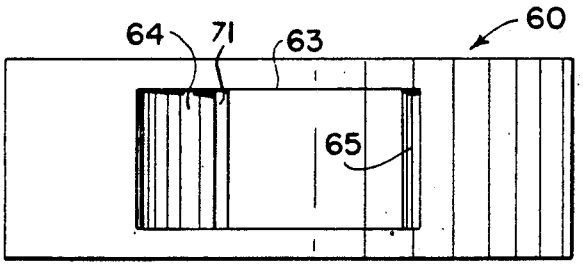
FIG. 7 is a partial cross-sectional view of the rotor showing construction features of the balancing chamber or reservoir.

FIG. 6 illustrates a rotary engine 50 having a rotor 60 that has been modified with a reservoir 66. The reservoir 66 is formed by partial closing of the normal depressions 68 in the rotor 60 with a shaped plate like member 63, or cap, that extends across depression 68, best shown with reference to FIG. 7. An opening or passageway 64 is formed by a surface of the cup-like depression and an elongated lip-like projection 71 formed on one edge of closure element 71. Lip-like portion projects inwardly toward the depression to form a tapered restricted opening defining a passageway at the mouth of balancing chamber 66. A substantially smaller opening 65 is located at the rear of reservoir 66 so that the reservoir 66 has a half circle seqmental cross-sectional area that tapers gradually in extending from lip 71 to opening 65. It is to be understood that other shaped chambers may be used as long as the balancing ratio of the volumes, formula 7, is considered. Although only a single reservoir is shown on rotor 60, it is to be understood that a reservoir of similar design is positioned on each of the other two rotor lobes shown. A shaft 62 with appropriate internal and external gearing is connected to rotor 60 for transmission of power to an external load.

Rotary engine 50 has two ported openings, intake 51 and exhaust 67, for intake and exhaust of gases, respectively. An intake tubular passage 49 formed with a venturi section 48 is attached to the housing of engine 50 and has its other end open to atmospheric air by means of a filter 43. A fuel supply tank 44 attached by means of fuel line 45 to extend adjacent to venturi 48 draws fuel into engine 50 by a lowered pressure area caused by air flow through venturi 48. An additional air vent 47, closed by filter 46 is positioned between the inlet port 51 and fuel port for supply of atmospheric air to passageway 49. It is to be understood that other fuel supply means such as fuel ejectors or like fuel delivery devices may be used for supplying fuel to rotary engine 50.

In operation, rotor 50 revolves around its own geometric center; at the same time, internal gears 62, within rotor 50, move its center in an eccentric path. The result is all three corners of the rotor lobes are in constant contact with the housing walls. As rotor 50 revolves, the three rotor lobes form three moving combustion chambers that are constantly changing in volume. This action in each of the three combustion chambers brings about the intake, compression, power and exhaust effect that is similar to the four-stroke cycle of the reciprocating engine.

FIG. 6 illustrates the rotor 60 at intake stroke in the combustion chamber of the rotor lobes equipped with balancing chamber 66. The intake port 51 has been uncovered by moving rotor and the combustion chamber begins to fill with our in passageway 49 and additional atmospheric air supplied by air vent 47. Immediately, thereafter, a fuel rich charge is supplied by means of venturi 48, fuel line 45 and air flowing through air filter 43. The first lean air in the combustion chamber flows in reservoir 66 and as the air/fuel charge continues to fill the combustion chamber the fuel rich air extends in a rich to lean mixture from the combustion housing to the rotor surface. As rotor 50 continues it closes the intake port 51 and the combustion chamber contains the maximum air-fuel charge. Continued rotation of the rotor decreases the volume of the combustion chamber, compressing the air/fuel charge and forcing air into the reservoir 66. A spark plug 61 ignites the compressed charge of gas causing expansion of the gases. Pressure increases at quasi-constant volume drives a compression shock wave into balancing chamber 66. At the same time the expansion wave which drive the shock wave propagates into the combustion chamber decreasing pressure. Because a pressure inbalancing occurs due to the shock wave the air within balancing chamber will flow out into the combustion chamber to supply air to sustain more complete burning. This oscillating action of compression-expansion continues a multiplicity of times throughout the rotor power stroke and thus supplies air during the entire combustion cycle in timed sequential relationship with the turning of rotor 60 dependent on ratio of the volume of the combustion chamber with respect to the volume of the reservoir and the size of passageway 64. The action of the balancing is to supply air and this air is such a lean mixture that no combustion of gases takes place in reservoir 66.

As can be ssen from the above description, the present invention provides an apparatus and techniques for providing control of pressure and temperature in the operation of an internal combustion engine either reciprocating or rotary of spark or compression ignition and two or four stroke configuration in a refined thermodynamic cycle by providing a balancing chamber and passageway or gap parameters that have a relationship with the combustion chamber volume of the engine. Variation of these parameters within certain limits will allow an engine to operate on a balanced heat cycle that has many of the advantages of both the Otto and Diesel cycles with few or none of their disadvantages. In particular an engine operating on a balanced cycle has better operating engine performance, overall engine speed and load conditions, better fuel economy and less emission of pollutants. These are some of the advantages not found in the prior art technique and devices mentioned above.

Obviously many modifications and variations of the present invention are possible in light of the above teachings. It is therefore to be understood that within the scope of the appended claims the invention may be practiced otherwise than as specifically described.

What is claimed is:

1. A time dependent process for carrying out an energy conversion cycle involving converting chemical energy into thermal potential by utilizing the pressure waves generated during the rapid reaction of a combustible fuel in the presence of oxygen and using the thermal potential for producing useful work in the combustion chamber of a piston type internal combustion engine operating over periodic cycles that each include an intake, compression, expansion (work producing) and exhaust event, comprising, for each cycle:

a) supplying air alone into a combustion chamber of the engine during the initial portion of the intake event;

b) adding fuel into the combustion chamber after the initial portion of the intake event but before ignition of the charge;

c) increasing the temperature of the total quantity of air and fuel admitted during the cycle by compressing at least the air during the compression event;

d) partially isolating a portion of the initially supplied air from substantially all of the later supplied fuel during the cycle by placing a portion of the initially supplied air in a reservoir chamber communicating with the combustion chamber through a narrow gap that permits transmittal of pressure gradients between the combustion and reservoir chamber, and maintaining the isolated portion of air in the reservoir chamber free from substantial contamination with fuel throughout the cycle, the ratio between the volume of the reservoir chamber and the combustion chamber at minimum volume being between 0.2 and 3.0, and the size of said gap measured across the narrowest dimension of the gap being between 0.05 and 0.2 in.;

e) igniting the fuel in the combustion chamber to initiate its rapid reaction near the end of the compression event to thereby generate a continuous series of pressure shock and expansion waves that traverse the combustion chamber and intersect the gap to produce a shock/expansion wave interaction between the combustion and reservoir chambers, and the gap;

f) repeatedly pumping air from the reservoir into the combustion chamber a plurality of times throughout the combustion reaction event by means of oscillating the shock/expansion waves between the combustion chamber walls, the gap and the reservoir chamber walls;

g) permitting expansion of the combustion chamber during the expansion (work producing) event; and h) exhausting the combustion chamber near the end of the expansion event.

* * * * *